US010056709B2

(12) United States Patent
Kashiwada

(10) Patent No.: US 10,056,709 B2
(45) Date of Patent: Aug. 21, 2018

(54) RUBBER PLUG FIXED BY A PLUG HOLDER TO A COVER FIXED TO A HOUSING

(71) Applicant: Sumitomo Wiring Systems, Ltd., Yokkaichi, Mie (JP)

(72) Inventor: Tomokazu Kashiwada, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/572,560

(22) PCT Filed: May 23, 2016

(86) PCT No.: PCT/JP2016/065131
§ 371 (c)(1),
(2) Date: Nov. 8, 2017

(87) PCT Pub. No.: WO2016/190268
PCT Pub. Date: Dec. 1, 2013

(65) Prior Publication Data

US 2018/0131118 A1 May 10, 2018

(30) Foreign Application Priority Data

May 28, 2015 (JP) ..... 2015-108323

(51) Int. Cl.
*H01R 13/40* (2006.01)
*H01R 13/44* (2006.01)
*H01R 13/52* (2006.01)

(52) U.S. Cl.
CPC ..... *H01R 13/44* (2013.01); *H01R 13/5205* (2013.01); *H01R 13/5213* (2013.01)

(58) Field of Classification Search
CPC ..... H01R 13/44; H01R 13/5202; H01R 13/5205; H01R 13/521; H01R 13/5213
(Continued)

(56) References Cited

U.S. PATENT DOCUMENTS 4,810,208 A * 3/1989 Hayes ..... H01R 13/5208 439/281
5,551,892 A 9/1996 Endo et al.
(Continued)

FOREIGN PATENT DOCUMENTS

| | | |
|---|---|---|
| JP | 7-122331 | 5/1995 |
| JP | 2015-082465 | 4/2015 |
| WO | 2014/069285 | 5/2014 |

OTHER PUBLICATIONS

English-Translate-Written-Opinion-PCT-JP2016-065131, dated Aug. 9, 1206.*

(Continued)

*Primary Examiner* — Chandrika Prasad
(74) *Attorney, Agent, or Firm* — Gerald E. Hespos; Michael J. Porco; Matthew T. Hespos

(57) ABSTRACT

A rubber plug assembly 40 disclosed by this specification is provided with a rubber plug 50 including a rubber plug body portion 51 for waterproofing the interior of a housing 20, leg portions 52 being provided around the rubber plug body portion 51, peripheral walls 54 of recesses (through holes 53) provided in the leg portions 52 being continuous without interruption, a cover 70 to be fixed to the housing 20 while covering the rubber plug 50, and a rubber plug holder 60 including rubber plug fixing portions 64 disposed on a side opposite to the cover 70 with respect to the leg portions 52, projections 66 to be fit into the recesses from the side opposite to the cover 70 being provided on the rubber plug fixing portions 64, the rubber plug holder 60 being fixed to the cover 70 with movements of the leg portions 52 along the cover 70 suppressed by locking the projections 66 to the peripheral walls 54 of the recesses.

4 Claims, 16 Drawing Sheets

(58) Field of Classification Search
USPC ..... 439/587, 588, 589, 272, 274, 275
See application file for complete search history.

(56) References Cited

U.S. PATENT DOCUMENTS

| | | | | |
|---|---|---|---|---|
| 6,371,807 | B1 * | 4/2002 | Takagishi ..... | H01R 13/5221 439/587 |
| 7,048,580 | B2 * | 5/2006 | Kobayashi ..... | H01R 13/5221 439/587 |
| 8,241,061 | B2 * | 8/2012 | Chazottes ..... | H01R 13/5213 439/272 |
| 9,203,178 | B2 * | 12/2015 | Sakakura ..... | H01R 13/5213 |
| 2015/0029067 | A1 | 1/2015 | Pang et al. | |

OTHER PUBLICATIONS

English-Translate-International-Search-Report-PCT-JP2016-065131, dated Aug. 9, 2016.*
International Search Report dated Aug. 9, 2016.

* cited by examiner

RUBBER PLUG FIXED BY A PLUG HOLDER TO A COVER FIXED TO A HOUSING

BACKGROUND

Field of the Invention

This specification relates to a rubber plug assembly.

Description of the Related Art

Japanese Unexamined Patent Publication No. 2015-82465 discloses a connector to be connected to a large-current cable. This connector includes a housing fittable into a mounting hole in a casing of a device. The inside of the housing receives a device-side terminal to be connected to a mating terminal, a wire-side terminal connected to a core of a wire, and a connecting member connecting the device-side terminal and the wire-side terminal. A voltage detection hole is open in an upper part of the housing and exposes a connecting part of a connection terminal and the wire-side terminal. Two the voltage detection holes are provided to correspond to a positive electrode and a negative electrode for causing respective lead rods of a tester to contact the connecting parts of the connection terminal and the wire-side terminal. Thus, a test can be performed to confirm that the connecting part of the connection terminal and the wire-side terminal are not charged.

Sealing plug bodies made of rubber are fit tightly into the voltage detection holes, thereby sealing the interior of the housing. The sealing plug bodies are mounted on a voltage detection cover to be attached to the upper part of the housing. However, the above-described sealing plug body includes a fixing portion to be press-fit and connected to a through hole provided through the voltage detection cover. If the sealing plug body is pulled strongly, the fixing portion may come out of the through hole and the sealing plug body may be detached from the voltage detection cover.

SUMMARY

A rubber plug assembly disclosed by this specification is provided with a rubber plug including a rubber plug body for waterproofing the interior of a housing. A leg is provided around the rubber plug body. A peripheral wall of a recess provided in the leg is continuous without interruption. A cover is to be fixed to the housing while covering the rubber plug, and a rubber plug holder including a rubber plug fixing portion is disposed on a side opposite to the cover with respect to the leg. A projection to be fit into the recess from the side opposite to the cover is provided on the rubber plug fixing portion. The rubber plug holder is fixed to the cover with a movement of the leg along the cover suppressed by locking the projection to the peripheral wall of the recess.

According to this configuration, the leg of the rubber plug is disposed between the rubber plug fixing portion of the rubber plug holder and the cover. Additionally, the projection of the rubber plug fixing portion is fit into the recess of the leg from the side opposite to the cover. Thus, a movement of the leg of the rubber plug along the cover is suppressed by locking the projection of the rubber plug fixing portion to the peripheral wall of the recess. Therefore, the detachment of the rubber plug from the cover due to the detachment of the leg of the rubber plug from the rubber plug fixing portion can be prevented.

The rubber plug holder may include a positioning pin for suppressing a movement of the rubber plug fixing portion in a direction away from the cover by being inserted into a positioning hole provided in the cover. According to this configuration, even if the rubber plug holder is, for example, forcibly inclined, the positioning pin interferes with the peripheral wall of the positioning hole so that a movement of the rubber plug fixing portion in the direction away from the cover is suppressed and the projection of the rubber plug fixing portion is held fit in the recess of the leg.

The rubber plug holder may include a lock for fixing the rubber plug holder to the cover by locking a locked portion provided on the cover, and two of the rubber plug fixing portions are disposed at both sides of the lock. If the rubber plug holder is inclined forcibly, the rubber plug fixing portions pivot about the lock portion. Thus, if one rubber plug fixing portion is separated from the cover, the leg of the rubber plug is sandwiched and retained firmly between the other rubber plug fixing portion and the cover. Therefore, the detachment of the rubber plug from the cover can be prevented more reliably.

According to the rubber plug assembly disclosed by this specification, it is possible to prevent the detachment of the rubber plug from the cover due to the detachment of the leg of the rubber plug from the rubber plug fixing portion.

DETAILED DESCRIPTION

Figure 1:
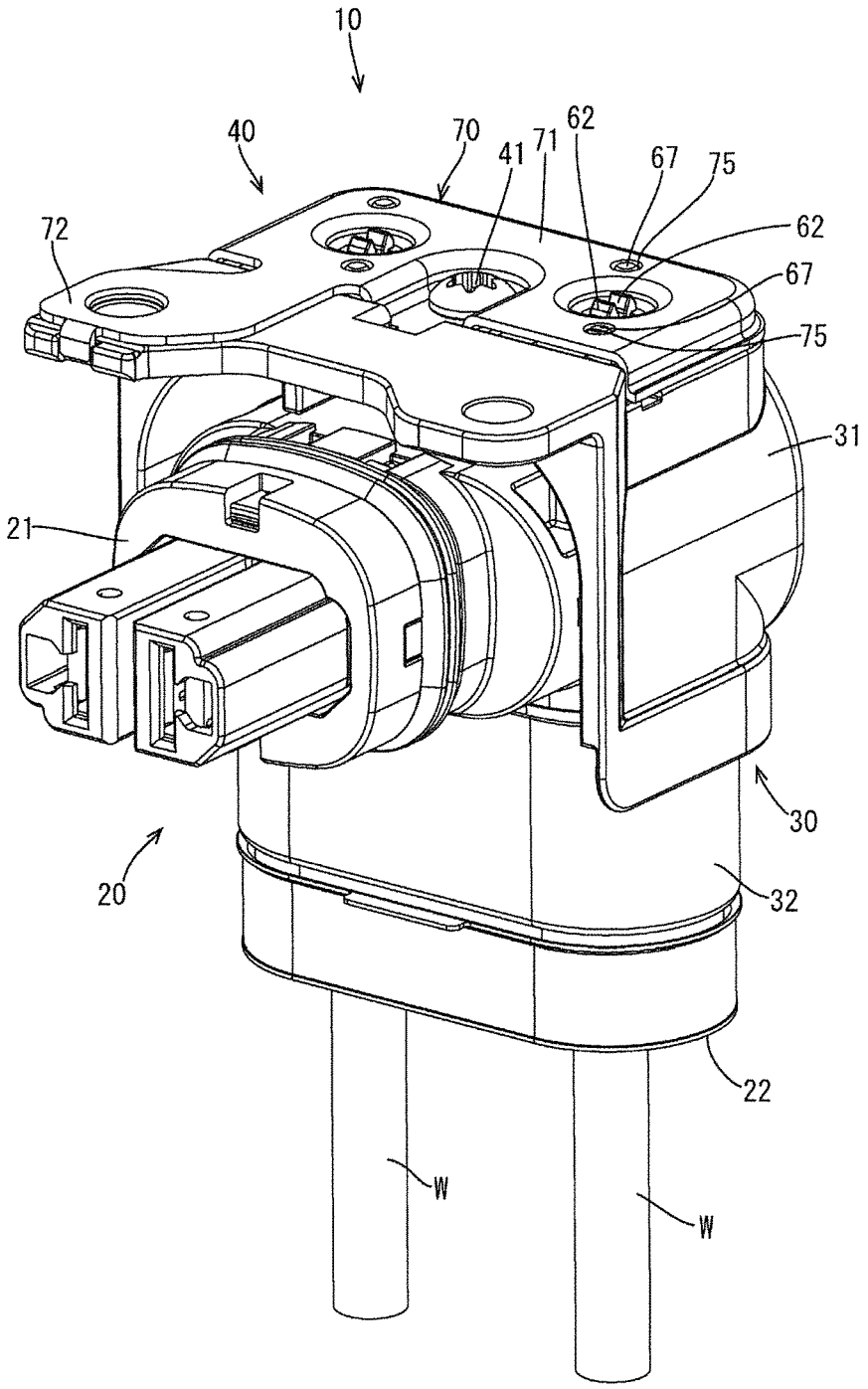
FIG. 1 is a perspective view of a connector in an embodiment.

An embodiment is described with reference to FIGS. 1 to 16. A connector 10 of this embodiment includes a housing 20 made of synthetic resin and a shield shell 30 made of metal for covering the housing 20, as shown in FIG. 1. The housing 20 is substantially L-shaped and includes a connector fitting portion 21 that projects forward and a wire pull-out portion 22 from which wires W are pulled out downwardly. The connector fitting portion 21 is fittable into a mounting hole provided in a casing of an unillustrated device. On the other hand, the shield shell 30 includes an upper shell 31 for covering the connector fitting portion 21 and a lower shell 32 for covering the wire pull-out portion 22.

Figure 2:
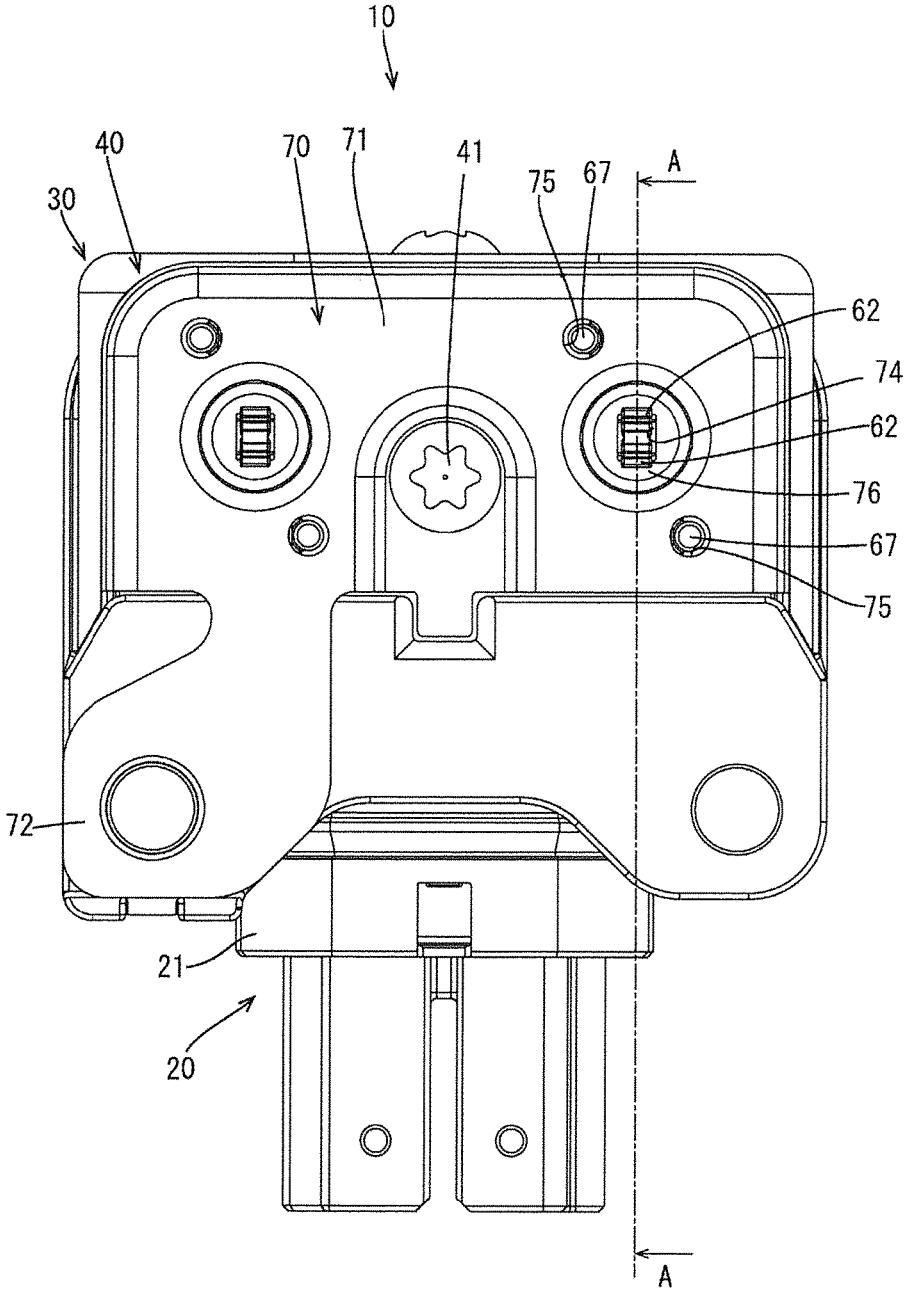
FIG. 2 is a plan view of the connector.

A rubber plug assembly 40 is attached to an upper part of the upper shell 31. As shown in FIGS. 4 to 7, the rubber plug assembly 40 is formed by integrally assembling two rubber plugs 50, two rubber plug holders 60 made of synthetic resin and a cover 70 made of metal with each other. As shown in FIG. 2, the rubber plug assembly 40 is attached by fastening a bolt 41 to an unillustrated nut fixed to the housing 20.

Figure 3:
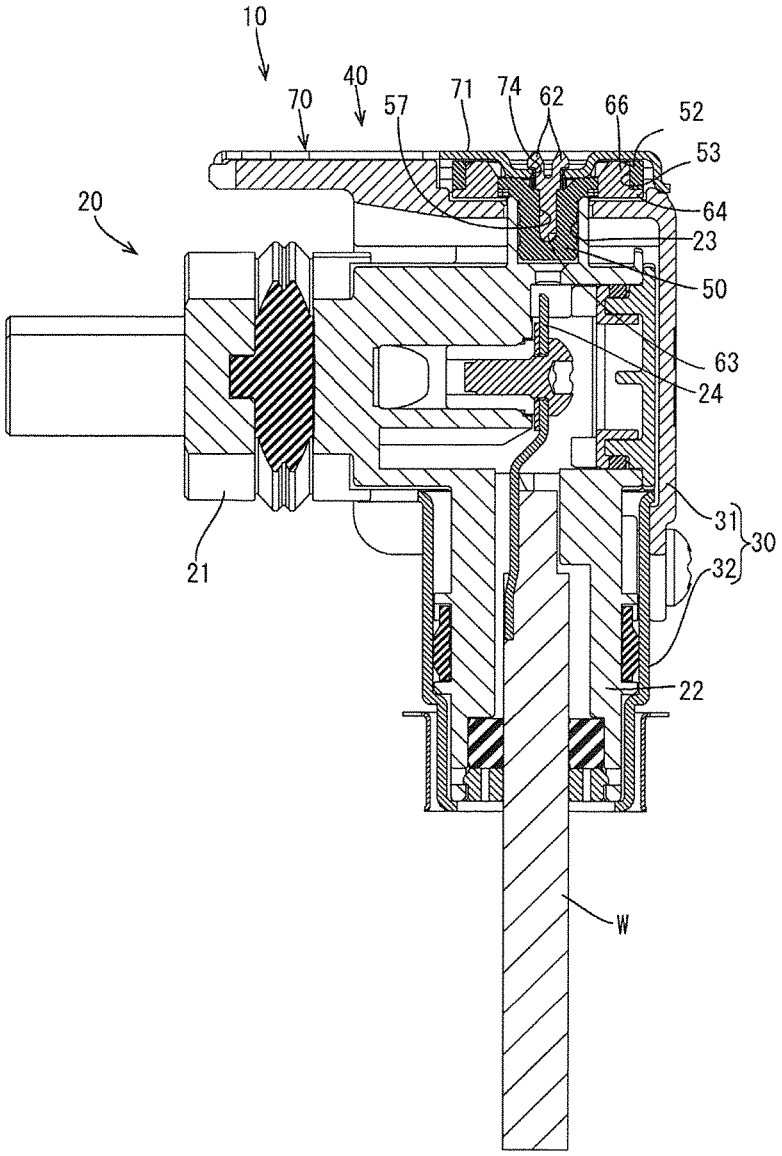
FIG. 3 is a section along A-A in FIG. 2.

As shown in FIG. 3, a voltage detection hole 23 is open in the upper part of the housing 20, and a wire-side terminal 24 connected to the wire W is disposed below this voltage detection hole 23. Thus, whether or not the wire-side terminal 24 is charged can be confirmed by inserting a lead rod of a tester through the voltage detection hole 23 and bringing the lead rod into contact with the wire-side terminal 24. The interior of the housing 20 can be waterproofed by fitting the rubber plug 50 into the voltage detection hole 23.

Figure 8:
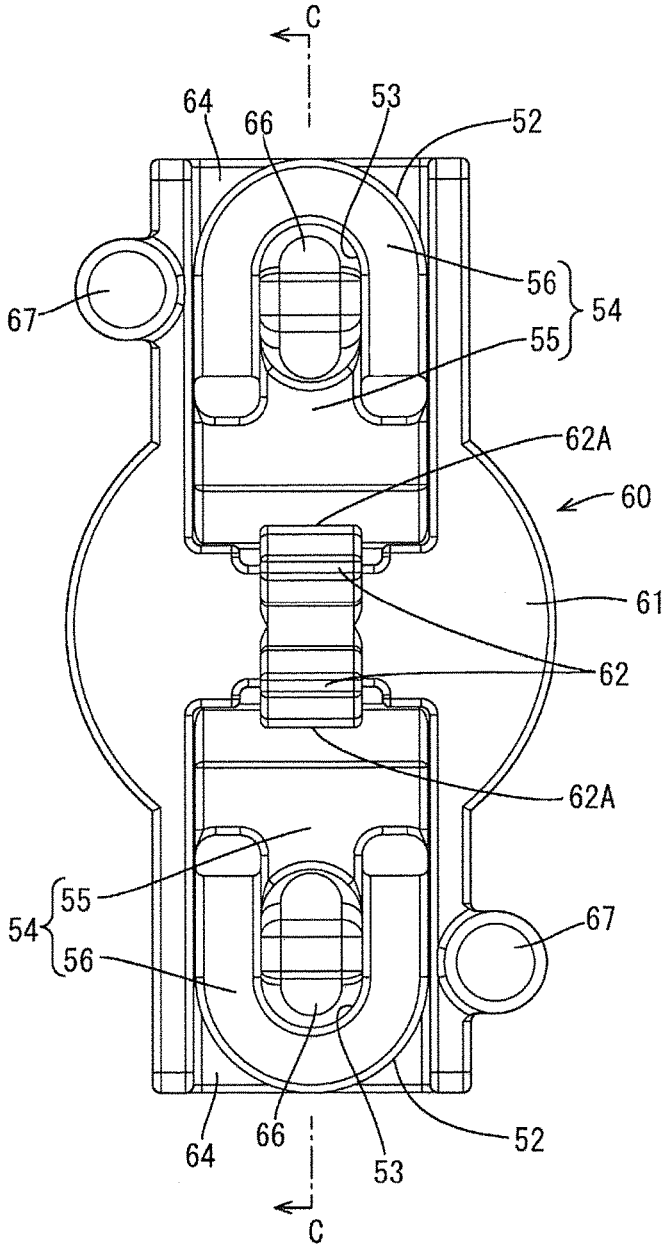
FIG. 8 is a plan view of a rubber plug assembled with a rubber plug holder.
Figure 9:
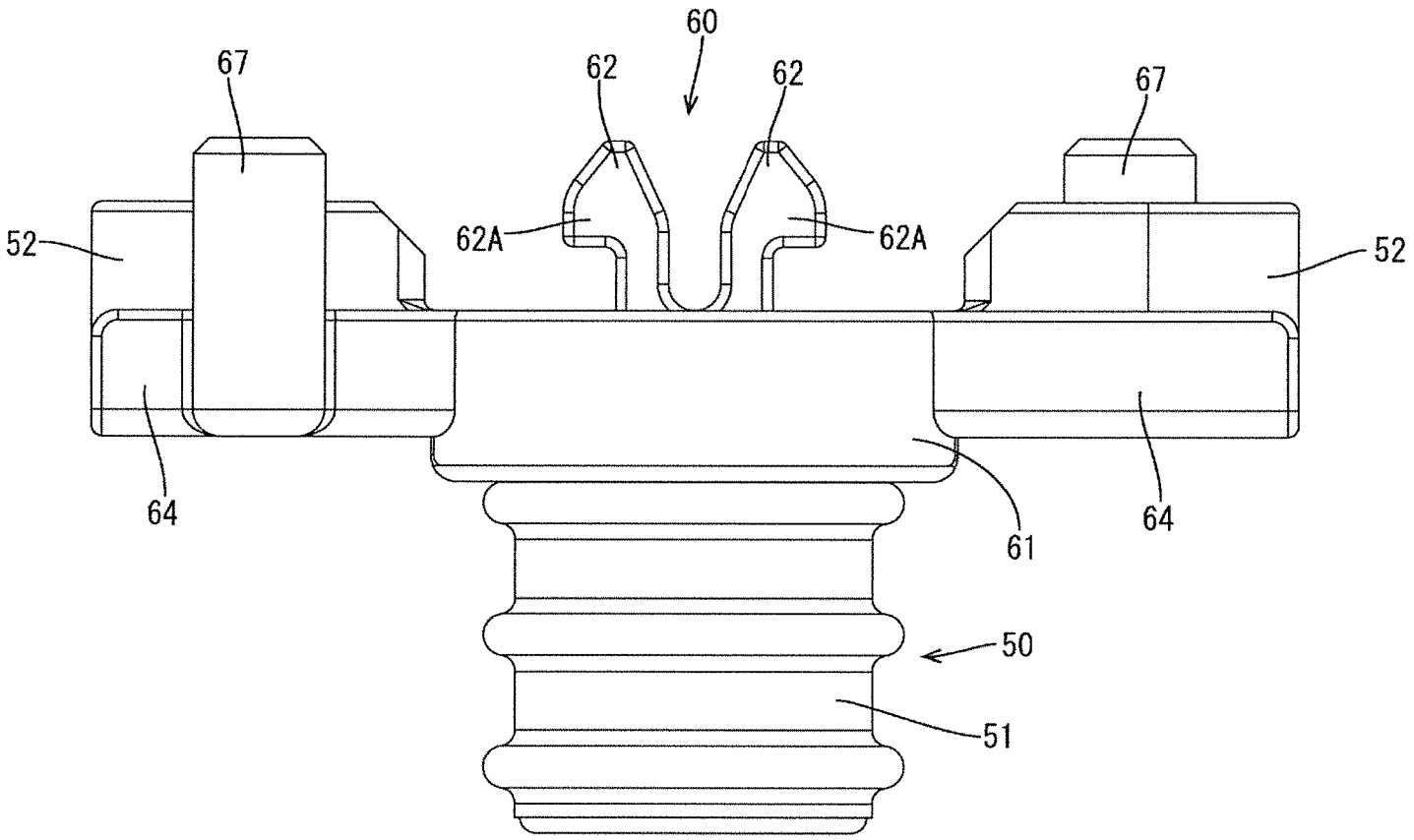
FIG. 9 is a front view of the rubber plug assembled with the rubber plug holder.
Figure 10:
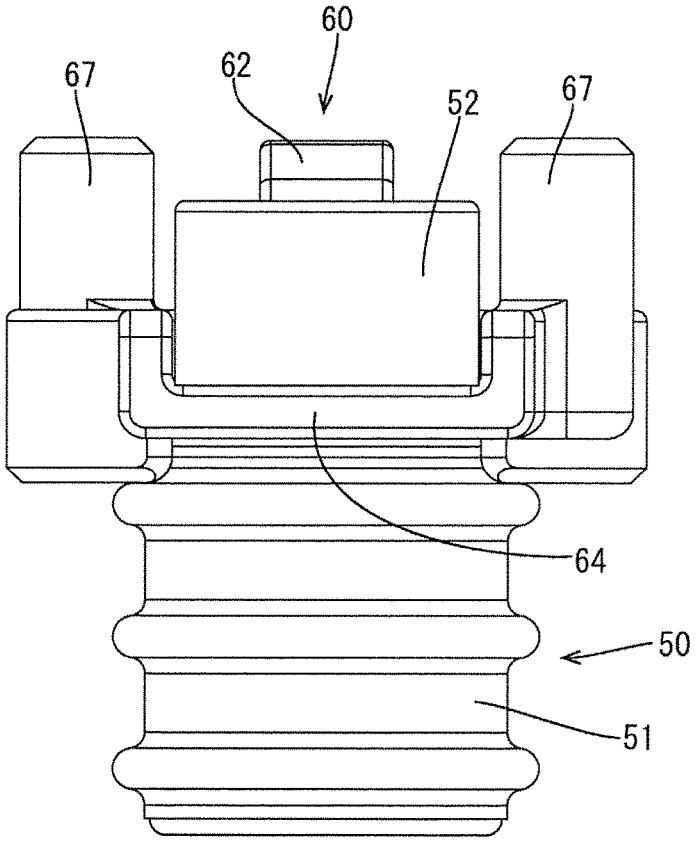
FIG. 10 is a side view of the rubber plug assembled with the rubber plug holder.
Figure 11:
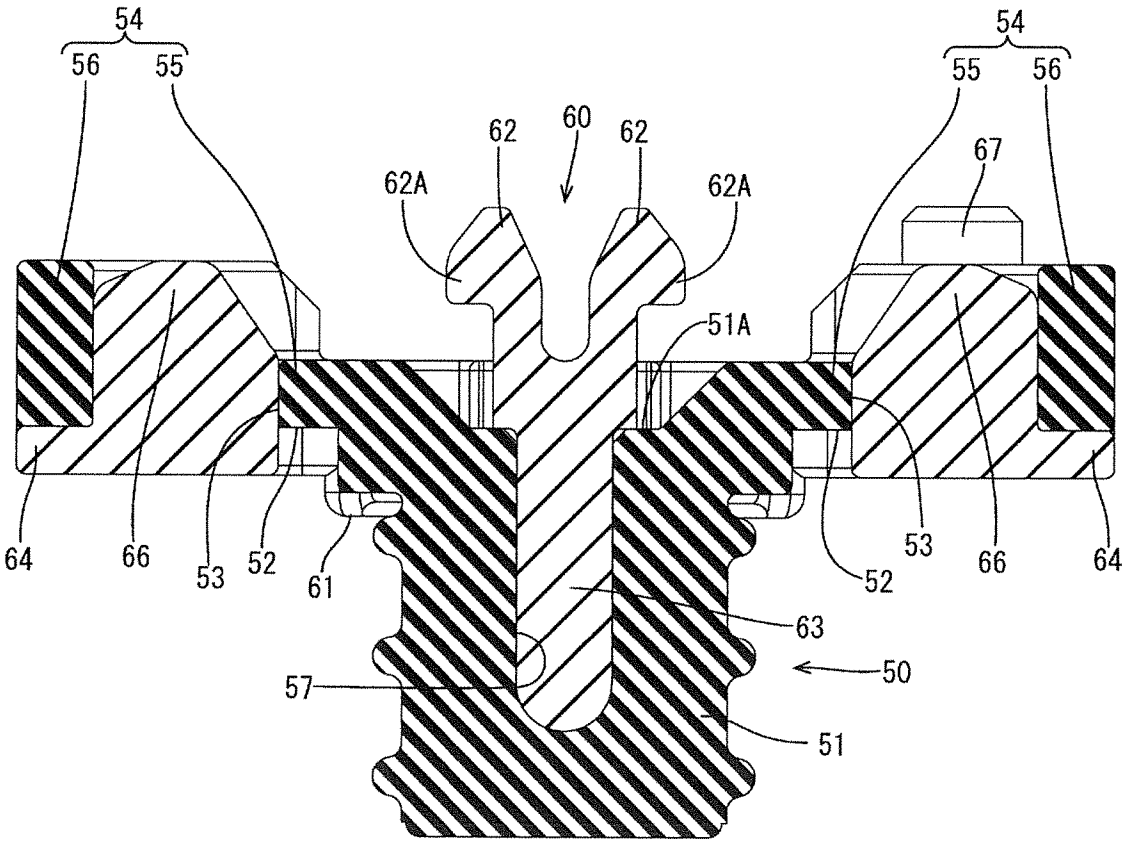
FIG. 11 is a section along C-C in FIG. 8.

Specifically, as shown in FIG. 11, the rubber plug 50 includes a cylindrical rubber plug body 51 and two legs 52 projecting radially out from an axial end part 51A of the rubber plug body 51. Each leg 52 is provided with a through hole 53. This through hole 53 is a closed hole and a peripheral wall 54 thereof is continuous without interruption as shown in FIG. 8. An inner part 55 of the peripheral wall 54 near the other leg 52 is thinner than a U-shaped outer part 56 excluding this inner part 55. A bottomed attachment hole 57 is provided inside the rubber plug body 51 and is open on the side of the axial end part 51A.

Figure 13:
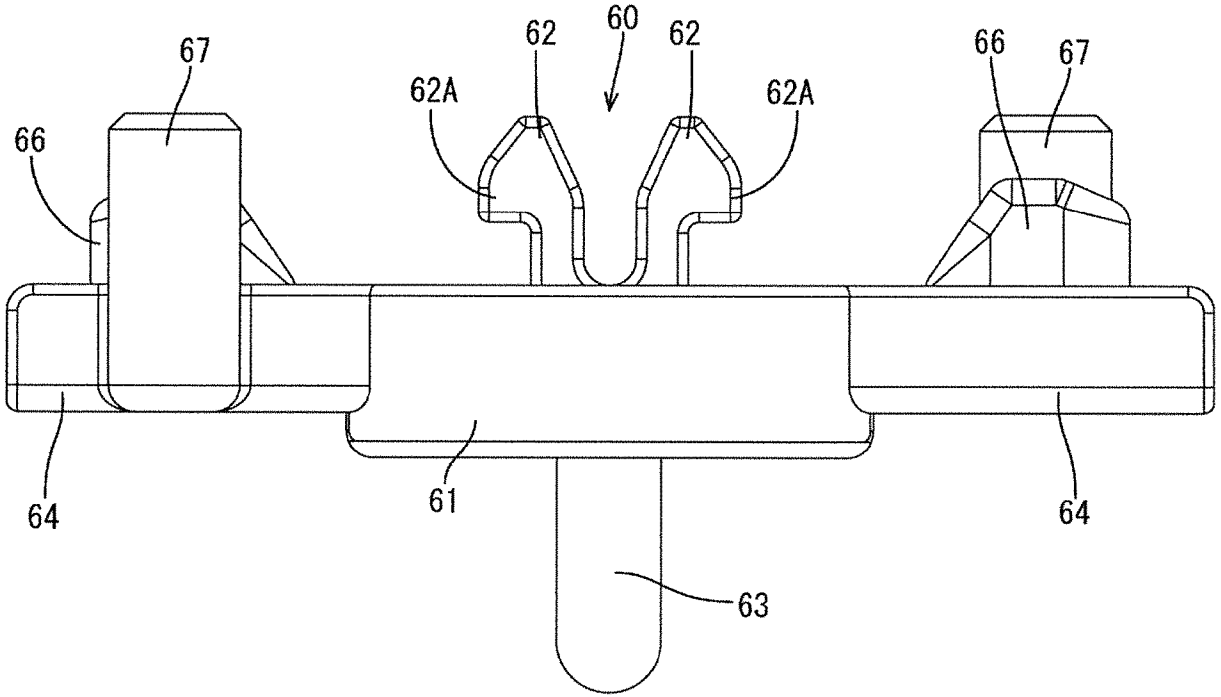
FIG. 13 is a front view of the rubber plug holder.
Figure 14:
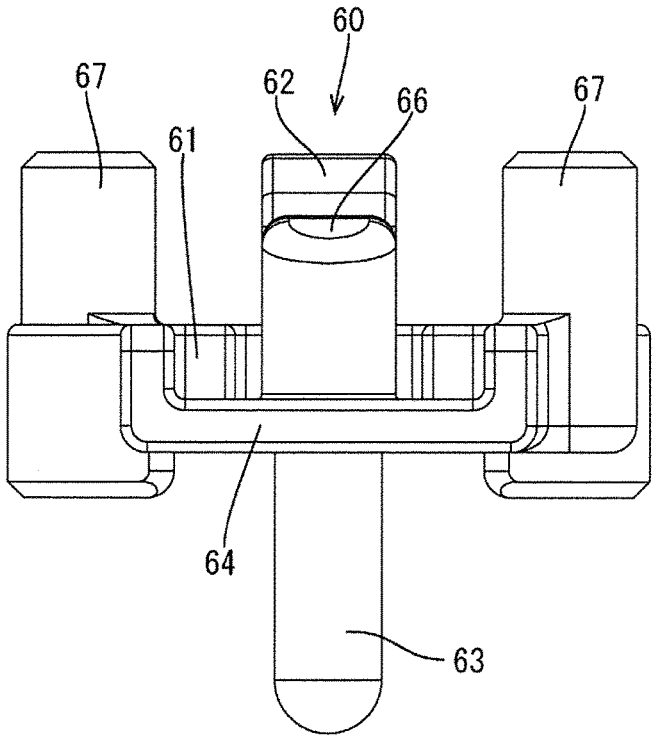
FIG. 14 is a side view of the rubber plug holder.
Figure 15:
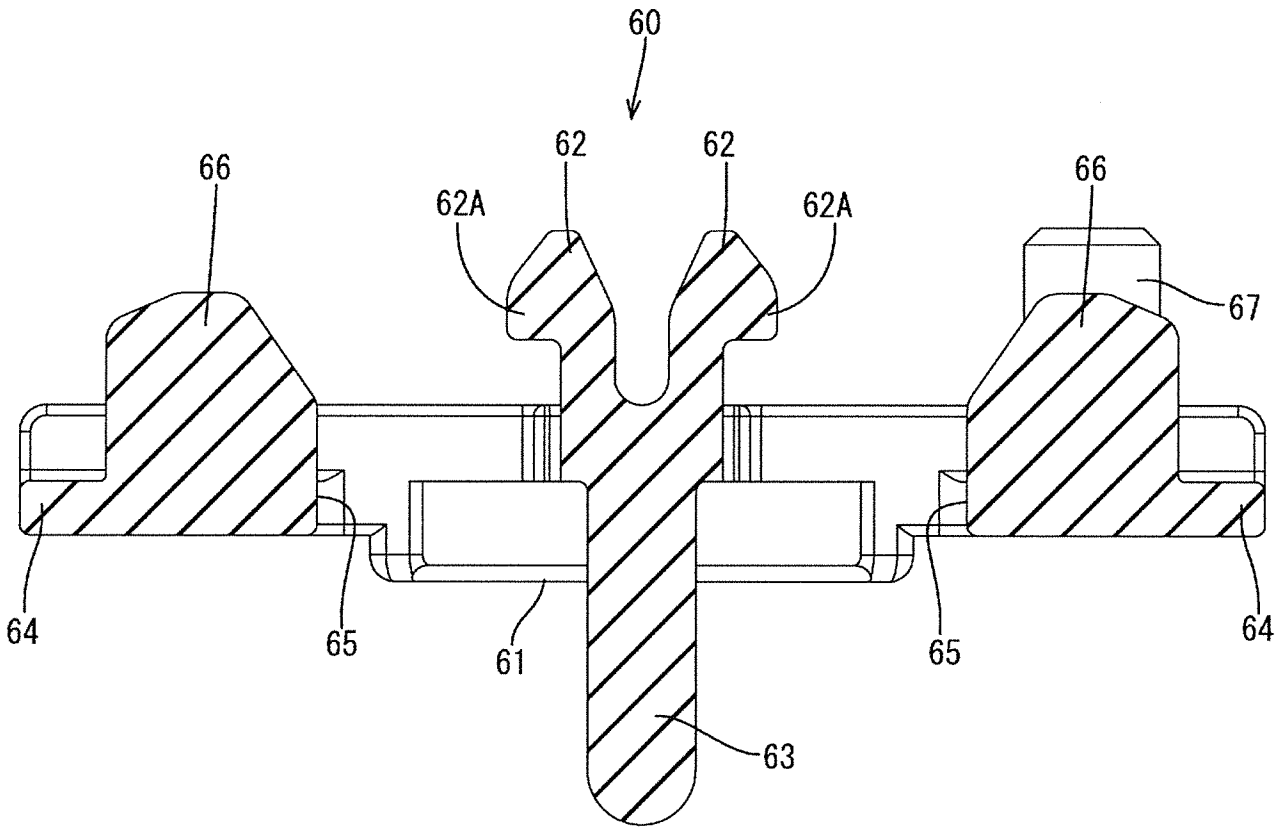
FIG. 15 is a section along D-D in FIG. 12.
Figure 16:
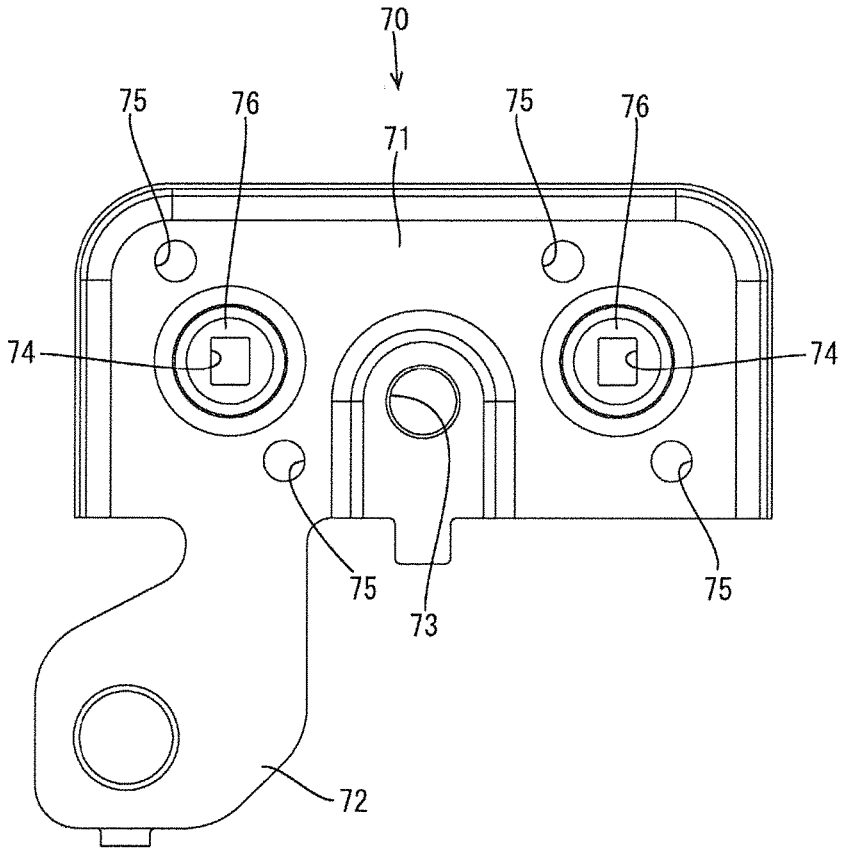
FIG. 16 is a plan view of a cover.

As shown in FIG. 13, the rubber plug holder 60 includes a holder body 61 to which the rubber plug body 51 of the rubber plug 50 is to be attached, and two rubber plug fixing portions 64 disposed on both sides of the holder body 61. The holder body 61 is provided with two lock pieces 62 projecting up and an attachment pin 63 projecting down. The respective lock pieces 62 are resiliently deformable and movable in directions toward and away from each other. Two lock projections 62A facing in opposite directions are respectively provided on tip parts of the lock pieces 62.

Figure 12:
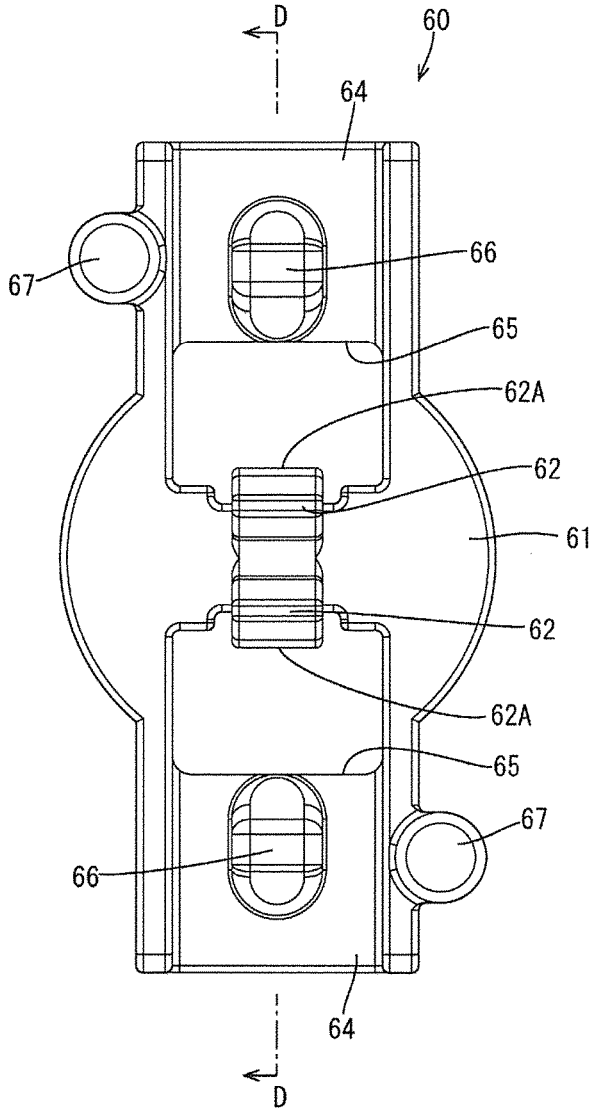
FIG. 12 is a plan view of the rubber plug holder.

As shown in FIG. 12, the holder body 61 has a substantially circular outer peripheral shape and two assembling holes 65 are provided between the rubber plug fixing portions 64 and the respective lock pieces 62 so that the rubber plug body 51 can be assembled with the holder body 61 through the respective legs 52 of the rubber plug 50. Further, two projections 66 are provided in central parts of the respective rubber plug fixing portions 64. Two positioning pins 67 are provided laterally of the respective projections 66 in the respective rubber plug fixing portions 64. The positioning pins 67 are disposed at positions offset from a line connecting the respective projections 66 and are point-symmetrical with respect to the lock pieces 62.

When the rubber plug 50 is assembled with the rubber plug holder 60, the attachment pin 63 is fit into the attachment hole 57 and each projection 66 is fit into each through hole 53 from below, as shown in FIG. 11. The attachment pin 63 is somewhat press-fit into the attachment hole 57. Thus, the rigidity of the rubber plug body 51 is enhanced by the attachment pin 63 and sealability for the voltage detection hole 23 is high. On the other hand, each projection 66 is substantially aligned with and fit into each through hole 53, and the upper end of each projection 66 is disposed at the same height as the upper end of the outer part 56 of each peripheral wall 54.

The cover 70 includes a cover body 71 having a laterally long and substantially rectangular shape and a connecting piece 72 protruding outward from a peripheral edge of the cover body 71. A bolt hole 73 through which the bolt 41 is to be inserted is open in a central part of the cover body 71. Further, two lock holes 74 are open at both sides of the bolt hole 73 in the cover body 71. Furthermore, two positioning holes 75 are open around each lock hole 74. A line connecting the positioning holes 75 obliquely intersects a line connecting the lock holes 74.

Figure 7:
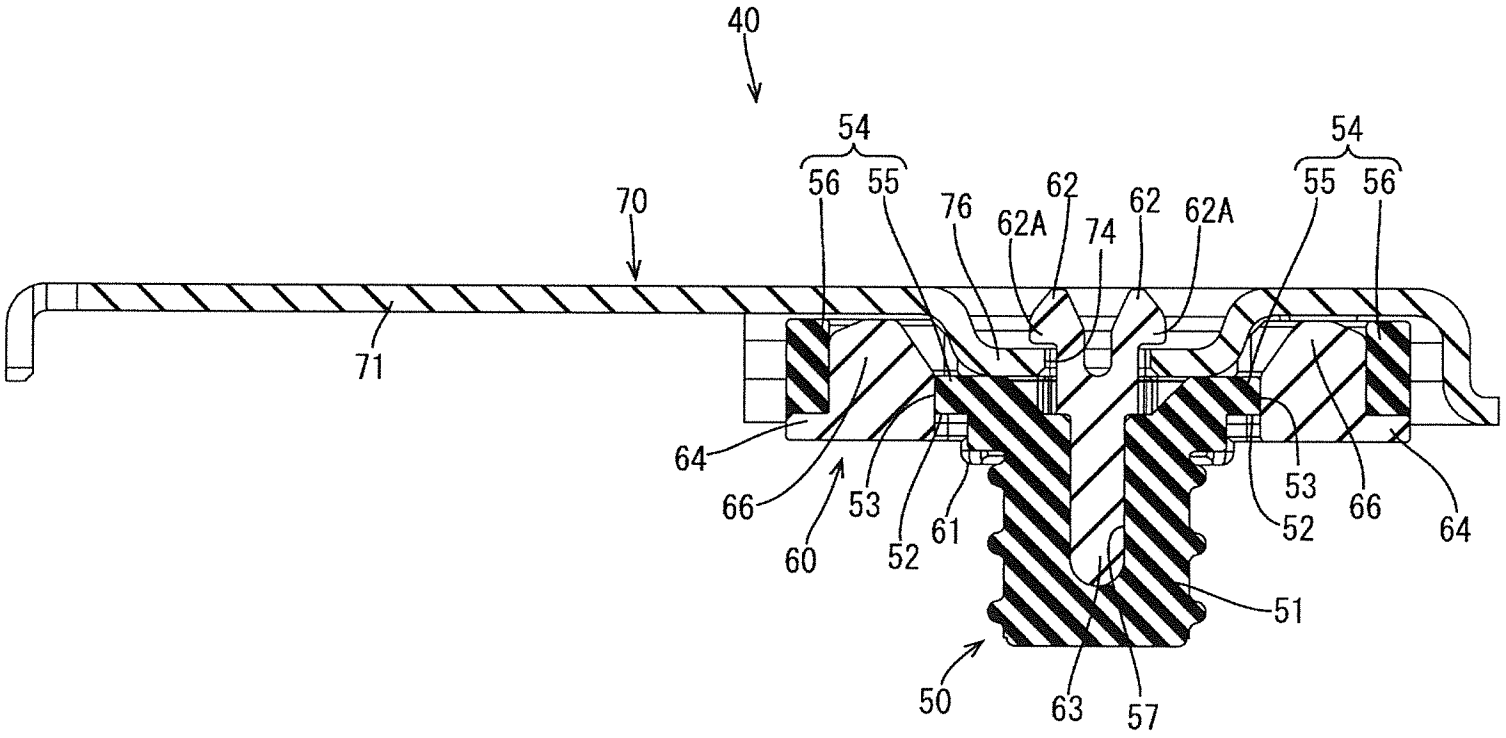
FIG. 7 is a section along B-B in FIG. 4.

When the rubber plugs 50 are assembled with the rubber plug holders 60 and these assemblies are assembled with the cover 70, the lock pieces 62 are fit into the lock holes 74 and the lock projections 62A are locked to edges of the lock holes 74, as shown in FIG. 7. Thus, the rubber plug holders 60 are held on the cover 70 and the rubber plug assembly 40 is configured. Lock hole surrounding parts 76 of the cover body 70 where the lock holes 74 are formed are recessed. Thus, the upper ends of the lock pieces 62 fit into the lock holes 74 and the upper surface of the cover body 71 are disposed substantially at the same height. Further, the inner parts 55 of the peripheral walls 54 are in contact with the lock hole surrounding parts 76 from below. On the other hand, the outer parts 56 of the peripheral walls 54 are disposed between the rubber plug fixing portions 64 and the cover body 71 to surround the projections 66.

The rubber plug holder 60 is mounted with play on the cover 70 and the tips of the projections 66 can contact the cover body 71 from below due to this play. In other words, each projection 66 is disposed with a tiny clearance formed between the projection 66 and the cover body 71. This clearance is sufficiently smaller than the height of the outer part 56 of the peripheral wall 54, and thus the outer part 56 of the peripheral wall 54 cannot pass through this clearance. The rubber plug 50 may be pulled down and the legs 52 may be pulled toward the holder body 61. However, the outer parts 56 of the peripheral walls 54 are held locked to the projections 66 and the rubber plug 50 will not detach from the cover 70 due to the detachment of the legs 52 of the rubber plug 50 from the rubber plug fixing portions 64.

Figure 4:
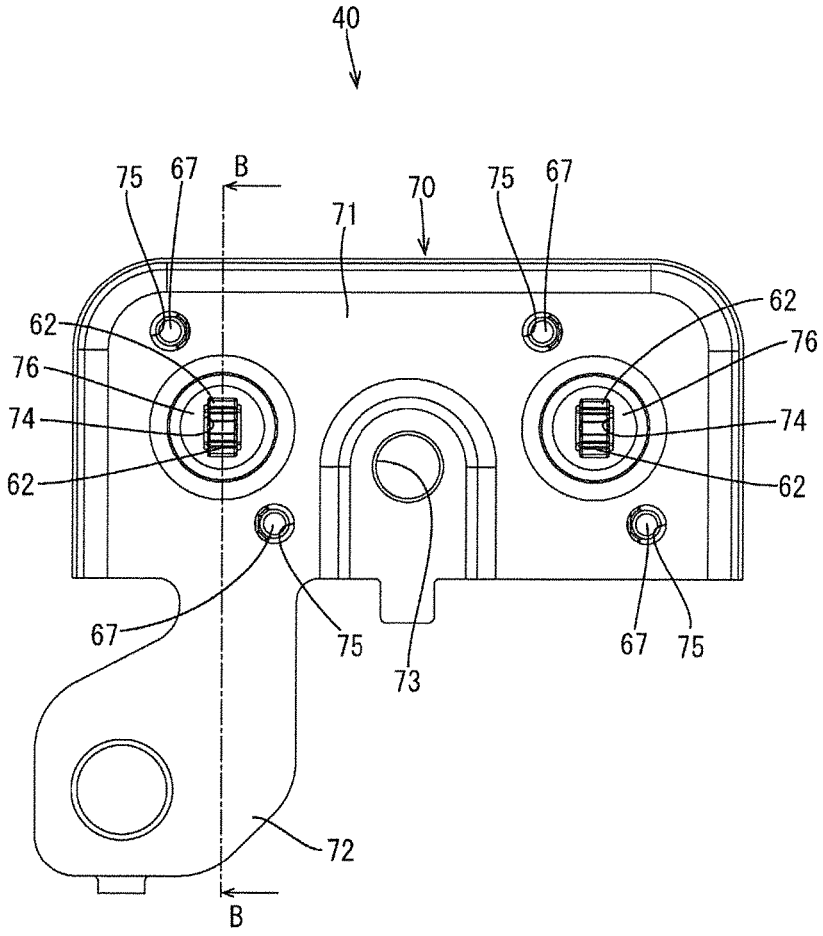
FIG. 4 is a plan view of a rubber plug assembly.
Figure 5:
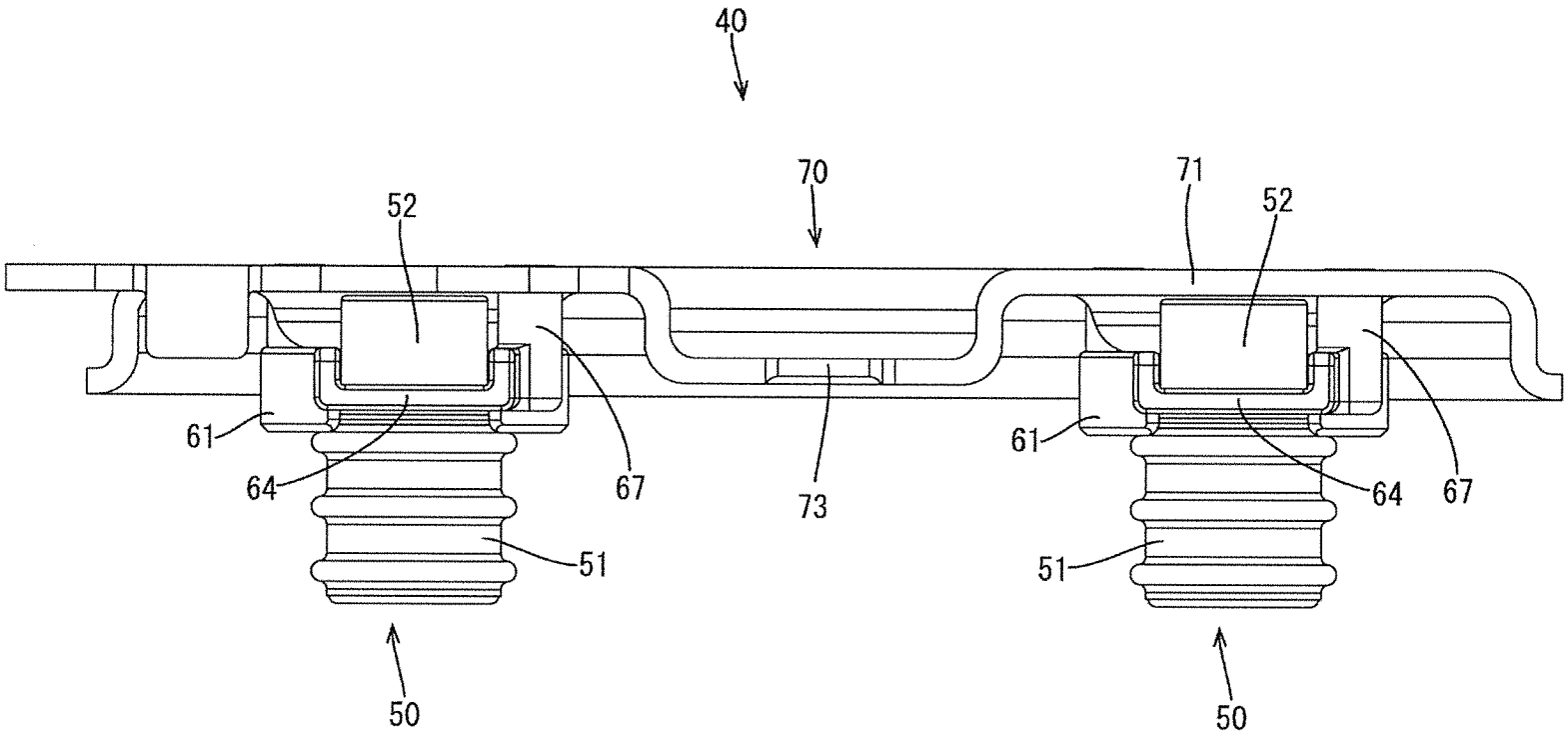
FIG. 5 is a front view of the rubber plug assembly.
Figure 6:
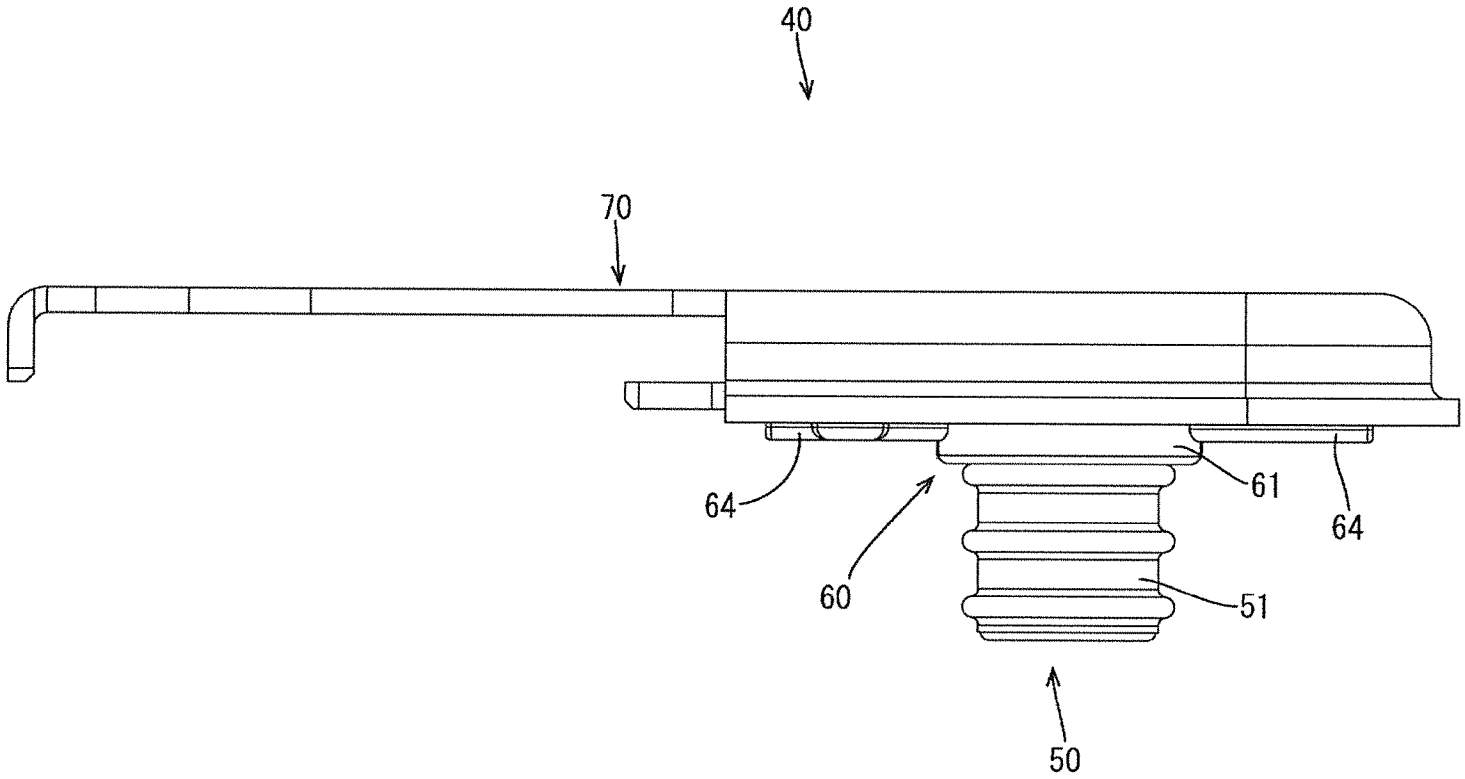
FIG. 6 is a side view of the rubber plug assembly.

Further, as shown in FIG. 4, each positioning pin 67 is inserted through each positioning hole 75. Even if the cover 70 is inclined when detaching the rubber plug assembly 40 from the upper shell 31, each positioning pin 67 interferes with the peripheral wall of each positioning hole 75. Thus, the inclination of the cover 70 is suppressed drastically and a movement of the cover body 71 in a direction away from each projection 66 is suppressed. Thus, each projection 66 is held fit in each through hole 53 and the detachment of each leg 52 from each rubber plug fixing portion 54 can be prevented.

Furthermore, even if one projection 66 (e.g. left one of FIG. 7) pivots about the lock pieces 62 in a direction away from the cover body 71, as shown in FIG. 7, after the rubber plug assembly 40 is detached from the upper shell 31, the other projection 66 (right one of FIG. 7) is in contact with the cover body 71 from below and the outer part 56 of the leg 52 is sandwiched firmly between the rubber plug fixing portion 64 and the cover body 71. Thus, the leg 52 at the other projection 66 is reliably retained in the rubber plug fixing portion 64.

As described above, the legs 52 of the rubber plug 50 are disposed between the rubber plug fixing portions 64 of the rubber plug holder 60 and the cover 70, and the projections 66 of the rubber plug fixing portions 64 are fit into recesses (through holes 53) of the legs 52 from a side opposite to the cover 70. Thus, the projections 66 of the rubber plug fixing portions 64 are locked to the peripheral walls 54 of the recesses, thereby suppressing movements of the legs 52 of the rubber plug 50 along the cover 70. Therefore, the rubber plug 50 will not detach from the cover 70 due to the detachment of the legs 52 of the rubber plug 50 from the rubber plug fixing portions 64.

The rubber plug holder 60 may include the positioning pins 67 for suppressing movements of the rubber plug fixing portions 64 in the direction away from the cover 70 by being inserted into the positioning holes 75 provided in the cover 70. According to this configuration, even if the rubber plug holder 60 is inclined forcibly, the positioning pins 67 interfere with the peripheral walls of the positioning holes 75. Thus, movements of the rubber plug fixing portions 64 in the direction away from the cover 70 are suppressed and the projections 66 of the rubber plug fixing portions 64 are held fit in the recesses of the legs 52.

The rubber plug holder 60 includes locks 62 for fixing the rubber plug holder 60 to the cover 70 by being locked to edges of the lock holes 74 provided on the cover 70, and the rubber plug fixing portions 64 are disposed at both sides of the lock 62. According to this configuration, if the rubber plug holder 60 is inclined forcibly, the rubber plug fixing portions 64 pivot about the lock 62. Thus, if one rubber plug fixing portion 64 is separated from the cover 70, the leg 52 of the rubber plug 50 is sandwiched firmly and retained between the other rubber plug fixing portion 64 and the cover 70. Therefore, the detachment of the rubber plug 50 from the cover 70 can be prevented more reliably.

The invention is not limited to the above described and illustrated embodiment. For example, the following various modes are also included.

Although the through hole 53 is illustrated as the recess provided in the leg 52 in the above embodiment, a bottomed recess may be provided.

Although the cover 70 is fixed to the housing 20 via the upper shell 31 in the above embodiment, the cover 70 may be fixed directly to the upper part of the housing 20.

The two positioning pins 67 are provided at diagonal positions of the rubber plug holder 60 in the above embodiment. However, only one, three or more positioning pins may be provided. Further, the positions of the positioning pin can be changed.

Although the rubber plug holder 60 is fixed to the cover 70 by fitting the pair of lock pieces 62 into the lock hole 74 in the above embodiment, a cover may be fixed to a rubber plug holder by a bolt.

Although the rubber plug 50 for waterproofing the voltage detection hole 23 is illustrated in the above embodiment, a hole for another purpose may be waterproofed by the rubber plug 50.

LIST OF REFERENCE SIGNS

20 . . . housing
40 . . . rubber plug assembly
50 . . . rubber plug
51 . . . rubber plug body
52 . . . leg
53 . . . through hole (recess)
54 . . . peripheral wall
60 . . . rubber plug holder
62 . . . lock piece (lock)
64 . . . rubber plug fixing portion
66 . . . projection
67 . . . positioning pin
70 . . . cover
74 . . . lock hole (locked portion)
75 . . . positioning hole

The invention claimed is:

1. A rubber plug assembly, comprising:

a rubber plug including a rubber plug body for waterproofing the interior of a housing, a leg provided around the rubber plug body, a peripheral wall of a recess provided in the leg being continuous without interruption;

a cover to be fixed to the housing while covering the rubber plug; and a rubber plug holder including at least one rubber plug fixing portion disposed on a side opposite to the cover with respect to the leg, a projection to be fit into the recess from the side opposite to the cover being provided on the rubber plug fixing portion, the rubber plug holder being fixed to the cover with a movement of the leg along the cover suppressed by locking the projection to the peripheral wall of the recess.

2. The rubber plug assembly of claim 1, wherein the rubber plug holder includes a positioning pin for suppressing a movement of the rubber plug fixing portion in a direction away from the cover by being inserted into a positioning hole provided in the cover.

3. The rubber plug assembly of claim 2, wherein the rubber plug holder includes a lock for fixing the rubber plug holder to the cover by locking a locked portion provided on the cover, and two of the rubber plug fixing portions are disposed at both sides of the lock.

4. The rubber plug assembly of claim 1, wherein the rubber plug holder includes a lock for fixing the rubber plug holder to the cover by locking a locked portion provided on the cover, and two of the rubber plug fixing portions are disposed at both sides of the lock.

* * * * *